US007854972B2

(12) United States Patent
Yoshiya

(10) Patent No.: US 7,854,972 B2
(45) Date of Patent: Dec. 21, 2010

(54) ORNAMENT AND METHOD OF MANUFACTURING THE SAME

(75) Inventor: Shun Yoshiya, Tokyo (JP)

(73) Assignee: Yugen Kaisha Shinjudo, Tokyo (JP)

( * ) Notice: Subject to any disclaimer, the term of this patent is extended or adjusted under 35 U.S.C. 154(b) by 1020 days.

(21) Appl. No.: 10/577,018

(22) PCT Filed: Oct. 26, 2004

(86) PCT No.: PCT/JP2004/015819

§ 371 (c)(1),
(2), (4) Date: Apr. 25, 2006

(87) PCT Pub. No.: WO2005/039344

PCT Pub. Date: May 6, 2005

(65) Prior Publication Data

US 2007/0084242 A1 Apr. 19, 2007

(30) Foreign Application Priority Data

Oct. 29, 2003 (JP) ..... 2003-368219

(51) Int. Cl.
*A44C 25/00* (2006.01)
*A44C 27/00* (2006.01)
*A44C 13/00* (2006.01)

(52) U.S. Cl. ..... 428/7; 63/30; 63/33; 63/38

(58) Field of Classification Search ..... 63/30, 63/38, 33; 79/10; 175/73
See application file for complete search history.

(56) References Cited

U.S. PATENT DOCUMENTS

2003/0121150 A1* 7/2003 Pratt ..... 29/896.4
2003/0154742 A1* 8/2003 Ooide ..... 63/38

FOREIGN PATENT DOCUMENTS

JP 63-85113 6/1988
JP 7-303507 11/1995
JP 3043339 9/1997
JP 10313920 A * 12/1998

OTHER PUBLICATIONS

PDF Translation of Kobe JP-63085113 U.*
English Language Abstracts of JP Pat. Pub. 63-85113, 07-303507 and 3043339. International Search Report.

* cited by examiner

*Primary Examiner*—Jennifer A Chriss
*Assistant Examiner*—Ricardo E Lopez
(74) *Attorney, Agent, or Firm*—Pillsbury Winthrop Shaw Pittman, LLP

(57) ABSTRACT

Disclosed is an ornament comprising a spherical body (D) with a through-hole (10) and a hanging wire member (6) inserted into the through-hole (10). The through-hole (10) is formed by connecting through a first hole (1) and a second hole (2) that are drilled toward the center (S) of the spherical body (P), respectively from right-left symmetrical positions in the upper half section (U) of the spherical body (D). A curved surface (5) is formed by cutting off the vertical type (4) of the inclined angle formed by the first hole (1) and the second hole (2) in the through-hole (10).

5 Claims, 2 Drawing Sheets

ORNAMENT AND METHOD OF MANUFACTURING THE SAME

FIELD OF THE INVENTION

The present invention relates to an ornament and a method of manufacturing the same, and more particularly to an ornament used in a hanging state as a necklace an earring and the like and a method of manufacturing the same.

BACKGROUND ART

A spherical hanging ornament whose front surface is specified is known. As shown in FIG. 1 of the following patent document 1, the spherical hanging ornament is, for example, a type of an ornament that is composed of a single pearl with a single diamond attached to the front thereof and worn by a body by being hung by a chain.

In this type of the ornament, when it is worn by a body, it is necessary that the ornament faces a definite and unchanged direction. When, for example, the ornament is worn by a body in the above example, the affinity of the ornament is reduced by half unless the diamond faces the front at all times when it is viewed from a user.

However, when a through-hole is formed to an ornamental spherical body itself and a wire member is inserted thereinto, the spherical body turns around the hanging wire member and is liable to change its direction.

Patent document 1: Japanese Unexamined Utility Model Application Publication No. 6-72407

DISCLOSURE OF THE INVENTION

In view of the above circumstances, an object of the present invention is to provide an ornament whose direction is not changed when it is used in a hanging state and a method of manufacturing the same.

To solve the above problem, an ornament according to the present invention is characterized by comprising a spherical body with a through-hole, wherein the through-hole is formed by connecting through a first hole and a second hole that are drilled toward the center of the spherical body from right-left symmetrical positions in the upper half section of the spherical body, and a curved surface is formed by cutting off the vertex section of an inclined angle formed in the spherical body by the first hole and the second hole. The "upper half section" in the spherical body is a relative section that is arbitrarily determined by a manufacturer of the ornament in the present invention.

According to the present invention arranged as described above, the through hole is formed in a right-left symmetrical shape in the upper half section of the spherical body as well as the center of gravity of the spherical body is located in the lower half section of the spherical body when the spherical body is hung by inserting the hanging wire member in the through-hole. As a result, since the spherical body is unlike to turn around the hanging wire member, the directions of the front and the back of the spherical body do not change. Accordingly, there can be provided an innovative ornament by, for example, burying a jewel in the front of the spherical body or by burying different jewels in both the front and the back thereof. Further, since the curved surface is smoothly formed in the through-hole, the hanging wire member can be inserted into the through-hole very easily.

A method of manufacturing an ornament according to the present invention is characterized by comprising a step of drilling a first hole and a second hole toward the center of a spherical body material from right-left symmetrical positions in the upper half section of the spherical body material until they are connected to each other, and a step of forming a curved surface by cutting off the vertex section of the included angle formed in the spherical body material by the first hole and the second hole.

As a preferable embodiment of the method of manufacturing the ornament, the vertex section may be cut off by inserting a tool from respective openings of the first and second holes after the diameters of the openings of the first and second holes are enlarged. The above arrangement is preferable because the tool can be easily inserted from the respective openings toward the vertex section.

An ornament according to an embodiment of the present invention is characterized by comprising a spherical body with a through-hole and a hanging wire member inserted into the through-hole, wherein the through-hole is formed by connecting through a first hole and a second hole that are drilled toward the center of the spherical body from right-left symmetrical positions in the upper half section of the spherical body, and a curved surface is formed by cutting off the vertex section of the included angle formed in the spherical body by the first hole and the second hole.

A method of manufacturing an ornament according to an embodiment of the present invention is characterized by comprising a step of drilling a first hole and a second hole toward the center of a spherical body material from right-left symmetrical positions in the upper half section of the spherical body material until they are connected to each other, a step of forming a curved surface by cutting off the vertex section of the included angle formed in the spherical body material by the first hole and the second hole, and a step of inserting the hanging wire member up to an opening of the second hole by inserting an end of a hanging wire member from an opening of the through-hole and by sliding the hanging wire member along the curved surface while displacing the spherical body material.

According to the manufacturing method, since the curved surface is formed by cutting off the vertex section in the spherical body material, the hanging wire member can be easily inserted from the first hole into the second hole, which is bent and connected to the first hole, by sliding the hanging wire member along the curved surface while displacing the spherical body material.

BEST MODE FOR CARRYING OUT THE INVENTION

Figure 5:
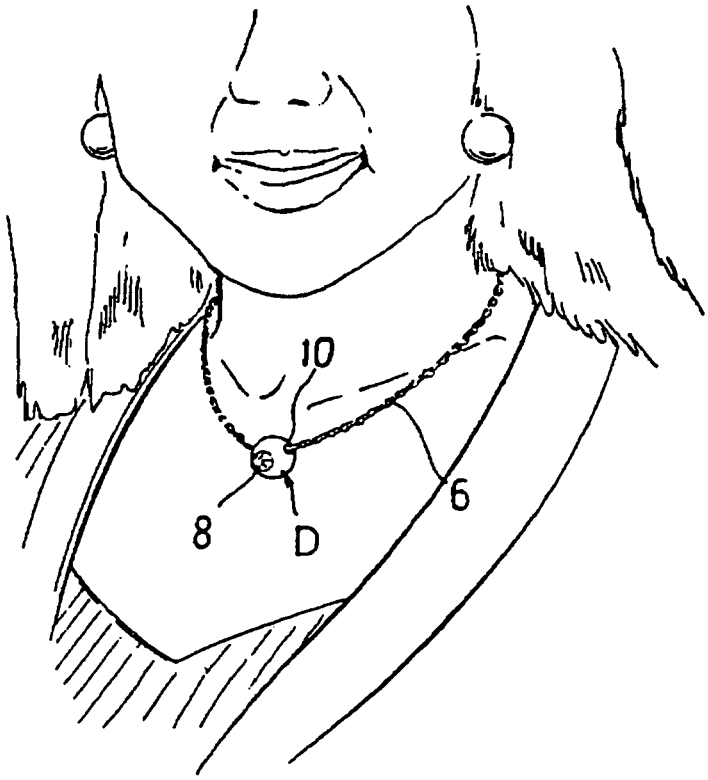
FIG. 5 is a perspective view showing a state in use of the ornament according to the embodiment of the present invention.

As shown in FIG. 5, an ornament according to an embodiment of the present invention includes an ornamental spherical body D with a through-hole 10, a hanging wire member 6 to be inserted into the through-hole 10. The ornamental spherical body D has an ornamental element such as a diamond 8 or the like fixedly attached to a position that faces the front by an appropriate method such as a burying method when the ornamental spherical body D is worn by a body in a state that it is hung by the hanging wire member 6. Materials suitable as an ornament, for example, a pearl and various kinds of jewels can be used as the spherical body D. Further, a material whose quality and shape are suitable as an ornament, for example, a precious metal chain can be used as the hanging wire member 6.

Figure 1:
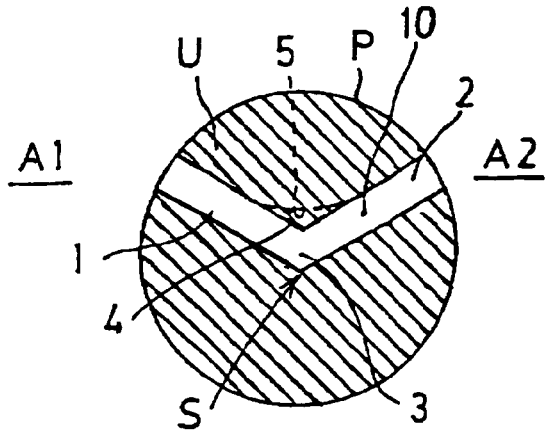
FIG. 1 is a sectional view of a main portion showing manufacturing steps of an ornament according to the embodiment of the present invention.

As shown in FIG. 1, the through-hole 10 is formed to the spherical body D. The through-hole 10 is formed by connecting through a first hole 1 and a second hole 2 that are drilled toward the center S of a spherical body material P, respectively from right-left symmetrical positions in the upper half section U of the spherical body material P. Specifically, the through-hole 10 can be formed as described below. The first and second holes 1, 2 are drilled from the right-left symmetrical positions A1 and A2 of the upper half section U toward the center S of the spherical body material P with a tool (not shown) (hole drilling step). However, the center S need not be an accurate center of the spherical body material P and may be a substantial center thereof. A carbide round cylinder bar or drill, or the like, for example, may be used as the tool.

The first and second holes 1, 2 are formed straight until they are connected to each other at the center S of the spherical body material P. Accordingly, the first hole 1 and the second hole 2 extend obliquely downward in the upper half section U from the surface of the spherical body material P, respectively, and the through-hole 10 is formed in a right-left symmetrical V-shape in the upper half section U of the spherical body material P. However, actually, since the trace of the extreme end of the tool, which was formed when the first hole 1 was drilled, and the trace of the extreme end of the tool, which was formed when the second hole 2 was drilled, remain, the first hole intersects the second hole at the center S of the spherical body material P.

In FIG. 1, the inclinations of the first and second holes 1, 2 may be set to about 30° with respect to a horizontal surface, respectively. That is, the angle between the central axial line of the first hole 1 and the horizontal section of the spherical body material P including the center S is set to about 30°, and the angle between the central axial line of the second hole 2 and the horizontal section of the spherical body material P including the center S is set to about 30° likewise. Further, the diameters of the first and second holes 1, 2 may be set to, for example, 1.6 mm although they are different depending on the size of the spherical body material P.

When the first hole 1 is connected to the second hole 2 in a communicating section 3 in the spherical body material P, an included angle formed in the spherical body material P has a vertex section 4 projecting downward. When the inclination angle of the first hole 1 with respect to the horizontal surface is set to 30° and the inclination angle of the second hole 2 with respect to the horizontal surface is set to 30°, the inclined angle is 120°. In the embodiment, a curved surface 5 is formed by cutting off the vertex section 4 of the included angle subsequent to the hole drilling step. The vertex section cutting-off step is carried out to easily carry out a job for inserting the hanging wire member 6 into the through-hole 10 by smoothly forming the bent section of the through-hole 10. A job for cutting off the vertex section 4 can be carried out by inserting a cutting tool having a diameter smaller than that at the hole drilling step into the first and second holes 1, 2.

Figure 2:
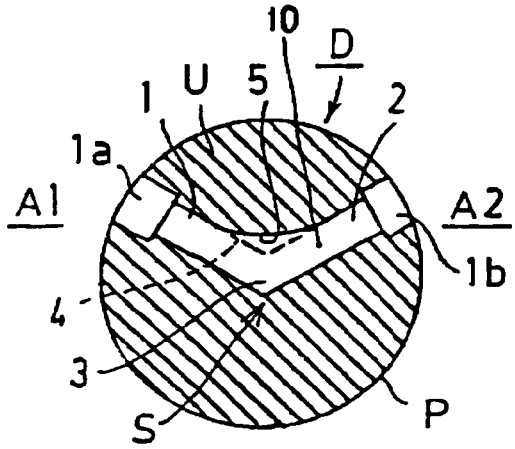
FIG. 2 is a sectional view of a main portion showing manufacturing steps of the ornament according to the embodiment of the present invention.
Figure 3:
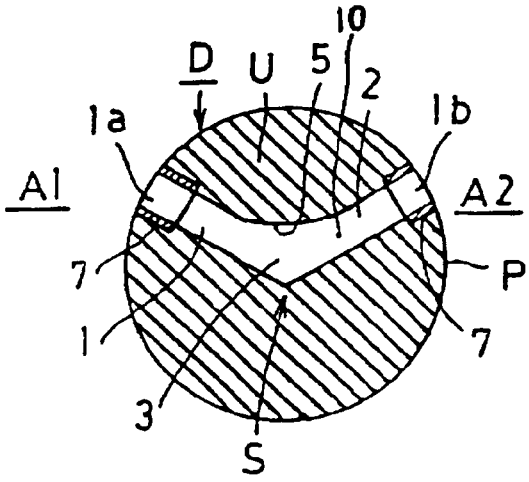
FIG. 3 is a sectional view of a main portion showing manufacturing steps of the ornament according to the embodiment of the present invention.

As shown in FIG. 2, the respective opening sections 1*a*, 1*b* of the first and second holes 1, 2 are preferably enlarged prior to the step for cutting off the vertex section 4. The opening section expansion job is carried out to make the vertex section cutting-off job easy. That is, the inner peripheral surfaces of the opening sections 1*a*, 1*b* of the first and second holes 1, 2 are cut off and the diameters thereof are enlarged to such sizes that permit the tool to be manipulated easily, taking it into consideration that the spherical body material P is small and the diameters of the first and second holes 1, 2 are also small. When, for example, the diameters of the first and second holes 1, 2 are set to 1.6 mm, the diameters of the opening sections 1*a*, 1*b* are preferably enlarged to about 2.3 mm.

In the cutting-off job of the vertex section 4, the vertex section 4 is cut off little by little and made smooth by inserting a tool into the first and second holes 1, 2. Although the tool is the same type as the tool used in the above hole drilling step, its diameter is smaller than the tool. Since the diameters of the opening sections 1*a*, 1*b* are expanded, the tool can be tilted more deeply in the first and second holes 1, 2, thereby the cutting-off job of the vertex section 4 can be easily carried out. The spherical body D is completed as shown in FIG. 2 by forming the curved surface 5 by cutting off the vertex section 4.

After the completion of the vertex section cutting-off job, reinforcing cylinder members 7 are fixedly disposed in the enlarged opening sections 1*a*, 1*b*. The cylinder members 7 protect the opening sections 1*a*, 1*b* as well as guide the hanging wire member 6 inserted into the through-hole 10. Further, the ornamental element such as the diamond 8 or the like is attached to the spherical body D at a position which becomes the front of the spherical body D when it is hung by the hanging wire member 6.

Figure 4:
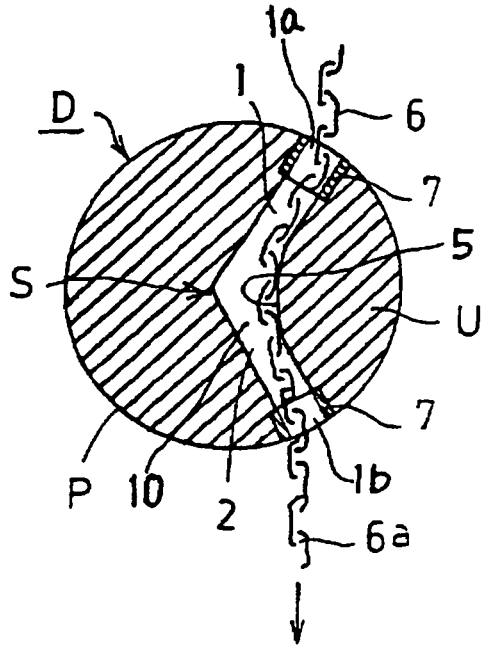
FIG. 4 is a sectional view of a main portion showing manufacturing steps of the ornament according to the embodiment of the present invention.

As shown in FIG. 4, the hanging wire member 6 is inserted into the through-hole 10 of the spherical body D. A specific method of inserting the hanging wire member 6 thereinto is as described below. First, the spherical body D is held such that the through-hole 10 extends in an up/down direction. Next, an end 6*a* of the hanging wire member 6 is inserted from the upward opening (for example, 1*a*) of the through-hole 10 in a hanging state, the hanging wire member 6 is slid along the curved surface 5 while appropriately moving the spherical body D, and then the one end 6*a* is drawn from the downward opening (for example, 1*b*) of the through-hole 10. <Thereafter, a pair of not shown connectors are connected to both the ends of the hanging wire member 6.

The ornament manufactured as described above can be used as a necklace as shown in, for example, FIG. 5.

According to the ornament, the through-hole 10 is formed in the upper half section of the spherical body D in the right and left symmetrical state as well as when the spherical body D is hung by inserting the hanging wire member 6 into the through-hole 10, the center of gravity of the spherical body D is located on the lower half section of the spherical body D. As a result, since the spherical body D is unlike to turn around the hanging wire member 6, the directions of the front and the back of the spherical body D do not change. Accordingly, a problem that the diamond 8 is hidden, and the like do not arise. Further, since the curved surface 5 is smoothly formed in the through-hole 10, the hanging wire member 6 can be inserted into the through-hole 10 very easily.

The invention claimed is:

1. An ornament, comprising:

a spherical body having only two holes, a first and a second hole that are positioned at right-left symmetrical positions in an upper half section of an outer surface of the spherical body;

a through-hole having a substantial V-shape and being formed by the first hole and second hole being respectively drilled toward a center of the spherical body, the substantial V-shape of the through-hole defining a vertex section that projects downward and is formed proximate to the center of the spherical body; and a curved surface that is formed by cutting off a portion of the downwardly projecting vertex section, wherein each of the first and second holes contains an opening section at a distal end section of the respective first and second holes, each of the opening sections having a diameter that is larger than a diameter along the non-distal section of the first and second holes such that a step is formed between the distal end section having the larger diameter and the non-distal section having the smaller diameter.

2. An ornament comprising:

a spherical body having only two holes, a first hole and a second hole that are positioned at right-left symmetrical positions in an upper half section of an outer surface of the spherical body;

a through-hole having a substantial V-shape and being formed by the first hole and second hole being respectively drilled toward a center of the spherical body, the substantial V-shape of the through-hole defining a vertex section that projects downward and is formed proximate to the center of the spherical body;

a hanging wire member inserted into the through-hole; and a curved surface that is formed by cutting off a portion of the downwardly projecting vertex section, wherein each of the first and second holes contains an opening section at a distal end section of the respective first and second holes, each of the opening sections having a diameter that is larger than a diameter along the non-distal section of the first and second holes such that a step is formed between the distal end section having the larger diameter and the non-distal section having the smaller diameter.

3. The ornament of claim 1, further comprising reinforcing cylindrical members that are fixedly disposed in the opening sections with enlarged diameters.

4. The ornament of claim 2, further comprising reinforcing cylindrical members that are fixedly disposed in the opening sections with enlarged diameters.

5. An ornament, comprising:

a spherical body having only two holes, a first and a second hole that are positioned at right-left symmetrical positions in an upper half section of an outer surface of the spherical body;

a through-hole having a substantial V-shape and being formed by the first hole and second hole being respectively drilled toward a center of the spherical body, the substantial V-shape of the through-hole defining a vertex section that projects downward and is formed proximate to the center of the spherical body; and a curved surface that is formed by cutting off a portion of the downwardly projecting vertex section.

* * * * *